US005678755A

United States Patent [19]

Block

[11] Patent Number: 5,678,755

[45] Date of Patent: Oct. 21, 1997

[54] PAPERBOARD CARTON HAVING A POUR SPOUT AND BLANK FOR FORMING THE SAME

[75] Inventor: Steven J. Block, Cincinnati, Ohio

[73] Assignee: James River Paper Company, Inc., Milford, Ohio

[21] Appl. No.: 688,801

[22] Filed: Jul. 31, 1996

[51] Int. Cl.[6] ..... B65D 5/74

[52] U.S. Cl. ..... 229/215; 229/240

[58] Field of Search ..... 229/214, 215, 229/240

[56] References Cited

U.S. PATENT DOCUMENTS

| | | | |
|---|---|---|---|
| 1,539,985 | 6/1925 | Allen | 229/215 |
| 1,907,939 | 5/1933 | Venning et al. | 229/215 |
| 2,358,659 | 9/1944 | Ringler | 229/215 |
| 3,292,839 | 12/1966 | Pike . | |
| 3,344,972 | 10/1967 | Robinson et al. | 229/215 |
| 4,054,240 | 10/1977 | LaPierre | 229/215 |
| 4,111,351 | 9/1978 | Mackiernan . | |
| 4,896,824 | 1/1990 | Aoki . | |
| 5,000,320 | 3/1991 | Kuchenbecker . | |
| 5,014,888 | 5/1991 | Bryan . | |
| 5,035,330 | 7/1991 | Kuchenbecker . | |
| 5,110,042 | 5/1992 | Hurden | 229/215 |
| 5,169,059 | 12/1992 | Desmond et al. . | |
| 5,316,212 | 5/1994 | Eriksson et al. . | |
| 5,322,211 | 6/1994 | Petersen . | |
| 5,326,024 | 7/1994 | Fogle . | |
| 5,531,376 | 7/1996 | Brink et al. | 229/215 |

*Primary Examiner*—Gary E. Elkins

*Attorney, Agent, or Firm*—Sixbey, Friedman, Leedom & Ferguson, P.C.; Charles M. Leedom, Jr.; Donald P. Studebaker

[57] ABSTRACT

A single paperboard blank for forming a carton having a tear open spout for dispensing material contained therein. The blank includes a first main panel with first and second side panels and end flaps hingedly connected thereto by way of fold lines. In addition, a second main panel is hingedly connected to the second side panel and includes a third side panel and end flaps hingedly connected thereto by way of fold lines. A closure flap is formed in the third side panel and a spout panel is hingedly connected to the third side panel. The formed carton has a plurality of side walls hingedly connected to one another by fold lines, a top wall and a bottom wall, with one of the side walls including an outer panel and an inner panel adhesively secured thereto with closure flap formed in the inner panel. A tear protective flap is formed in the outer panel for sealing the carton until the initial use. The spout is hingedly connected with the inner panel and adhered to the closure flap, such that, the spout and the closure flap extend outward from the carton when opened to form the passage through which the material in the carton may be poured. Retention wings are included on the spout to keep it from opening too far and to constrict the flow of material from the carton.

20 Claims, 5 Drawing Sheets

PAPERBOARD CARTON HAVING A POUR SPOUT AND BLANK FOR FORMING THE SAME

TECHNICAL FIELD OF THE INVENTION

The present invention relates to a pour spout for a paperboard carton, and more particularly to a reclosable pour spout formed in a side wall of a paperboard carton.

BACKGROUND OF THE INVENTION

Disposable paperboard cartons have been commercially available for a considerable time and have uses for storing, transporting and selling both powder and granular type materials. These paperboard cartons have been equipped with a variety of pour spouts for emptying the contents of the cartons. Pour spouts manufactured from metal, plastic and paperboard have been used for this purpose. For decades metal and plastic pour spouts which hinged to the cartons were used to allow easy opening of the carton for initial use and easy closing of the carton for storage. The use of metal and plastic pour spouts in a paperboard carton, however, proved costly to manufacture. Consequently, the paperboard carton industry sought a more cost effective means to manufacture disposable paperboard cartons that provided the ease-of-use equated to the metal and plastic pour spouts but at a reduced manufacturing cost.

One such design is found in U.S. Pat. No. 3,292,839 to Pike which discloses a box spout formed from a lining on the interior of the box. The lining forms the sides of the spout creating a web like structure. Although, the Pike design does not have a metal or plastic spout, the manufacturing cost for the Pike carton is still significant because of the separate lining material used on the interior portion of the carton and for the sides of the spout. Having a paperboard box comprised of two different materials undoubtedly increases the manufacturing cost due to the added material.

Manufacturers began to recognize the advantage of creating a carton completely from paperboard. An example of these designs may be found in U.S. Pat. No. 5,014,888 to Bryan which discloses a paperboard container including a perforated seal which must be broken initially in order to remove the pour spout from the container and U.S. Pat. No. 4,111,351 to Mackiernan which discloses a paperboard carton having a paperboard spout with an automatic locking arrangement. The problem associated with the Bryan and Mackiernan designs is that the spout is manufactured separately from and is adhered to the paperboard container. This can be troublesome for a consumer, in that, the spout may break off from the container, thus, eliminating the closure element and ultimately causing possible leakage or spillage from the container. In addition, because the carton is not made from a single paperboard blank, manufacturing the two parts separately becomes costly.

The industry has responded to the deficiencies in the above designs and currently manufacture paperboard cartons having a pour spout simultaneously formed in the paperboard constituting the carton. U.S. Pat. No. 5,322,211 to Peterson discloses a packaging carton for dry, flowable products which is formed form a single flat carton member with pre-punched and pre-scored folding lines. The carton includes a reclosable pouring spout at an upper end portion. The spout design of Petersen, however, does not appear to create a secure closure to keep the contents of the container from spilling or leaking once the package is opened. Moreover, the pour spot design does not provide the ease of use normally associated with the metal and plastic spout designs.

U.S. Pat. No. 5,326,024 to Fogle discloses a carton with a reclosable opening having upper end panel sections connected to side panels sections by overlapping horizontal flaps. Separation of an end tear strip portion of the horizontal flaps allows an upper end panel section to be folded out to form a pouring spout. A tab remaining after separation of the tear strip portion is inserted into a slit in the upper end panel section to hold the section in place after being reclosed. The Fogle pour spout design is rather complex, in that, to open and close the spout, a user must open a top lid and then unfold the upper end panel. The constant folding and unfolding of the lid and upper panel eventually weakens the paperboard surrounding the spout, thus, possibly causing leakage and spillage over time. Moreover, the opening of the carton is wide making it difficult to constrict the flow of the materials in the carton when pouring.

It is clear that there is a need for a paperboard carton that is inexpensive to manufacture and also desirable to a consumer for its ease-of-user and durability. To this end, paperboard cartons made from a single blank and having a sidewall pour spout provide a container that is easy to manufacture and use. Having the sidewall pour spouts maintains the integrity of the box design and allows the user to pour the contents from the container with relative ease. Examples of these designs are found in U.S. Pat. Nos. 5,000,320 and 5,035,330, both to Kuchenbecker and assigned to James River Corporation. Each reference teaches a pour spout formed in the side wall of a carton wherein the spout is integrally formed with the carton blank.

Although the Kuchenbecker references disclose paperboard cartons that are formed from a single blank and have a sidewall pour spout, the ease-of-use normally associated with the metal and plastic pour spouts has still not been realized in the currently manufactured paperboard cartons. In addition, there is also a need to control the size of the opening of the carton to constrict the flow of the materials being poured from the container. This feature would allow a consumer to more readily monitor the amount of material being poured to more accurately measure the amount of material desired. There is a further need for a simplified paperboard carton design that allows for a secure seal after each use to avoid any possible leakage or spilling.

SUMMARY OF THE INVENTION

It is therefore an object of the present invention to provide an improved carton having an improved sidewall pour spout manufactured from a single paperboard blank.

It is also an object of the present invention to provide a carton having an improved pour spout that may be opened and reclosed repeatedly by a consumer.

It is further an object of the present invention to provide a single paperboard blank that can be easily folded to yield a durable carton having an easy-to-use sidewall pour spout.

It is also another object of the present invention to provide a carton having an improved pour spout that may be tightly sealed after each use.

It is a further object of the present invention to provide a carton having an improved pour spout that constricts the flow of the materials being poured from therethrough to allow a consumer to meter the amount of material being poured out of the carton.

These and other objectives are achieved by providing a carton having a tear open spout for dispensing material contained therein. The paperboard blank used in forming the carton has a first main panel with first and second side panels and end flaps hingedly connected thereto by way of fold lines; a second main panel hingedly connected to the second side panel and having a third side panel and end flaps hingedly connected thereto by way of fold lines; a closure flap formed in the third side panel; and a spout panel hingedly connected to the third side panel, wherein the spout panel is folded to form a spout which is covered by the closure flap when the carton is formed. The closure flap and the spout are adhered together and extend outward from the carton when opened to form a spout through which material in the carton may be poured.

The blank is formed of paperboard and the first and second side panels each include at least one flap hingedly connected thereto at a crease score fold line. When the carton is assembled, the first side panel covers the closure flap to form a protective flap which is torn away by a consumer to access the closure flap for pouring the contents of the carton. The protective flap is embossed at the crease score fold line. The third side panel includes an embossed reversed cut score region adjacent the second panel on which the protective flap is adhered when the carton is formed, such that upon application of an opening force an area of paperboard material between the reverse cut scores will ply separate and release the protective flap.

The spout panel includes a main spout panel and a first and second side spout panel. The first side spout panel and the main spout panel have bottom panels connected thereto. The first and second side spout panels include retention wings which form the curved side walls of the spout when constructed.

The formed carton has a plurality of side walls hingedly connected to one another by fold lines, a top wall and a bottom wall, with one of the side walls including an outer panel and an inner panel adhesively secure thereto. In addition, the carton includes a closure flap formed in the inner panel; a tear away protective flap formed in the outer panel for sealing the carton until the initial use; and a spout hingedly connected with the inner panel and adhered to the closure flap, wherein the spout and closure flap configuration extend outward from the carton when opened to form an area through which the material in the carton may be poured. Retention wings are included on the spout to keep it from opening too far and to constrict the flow of material from the carton.

DETAILED DESCRIPTION OF THE PREFERRED EMBODIMENT

Figure 1:
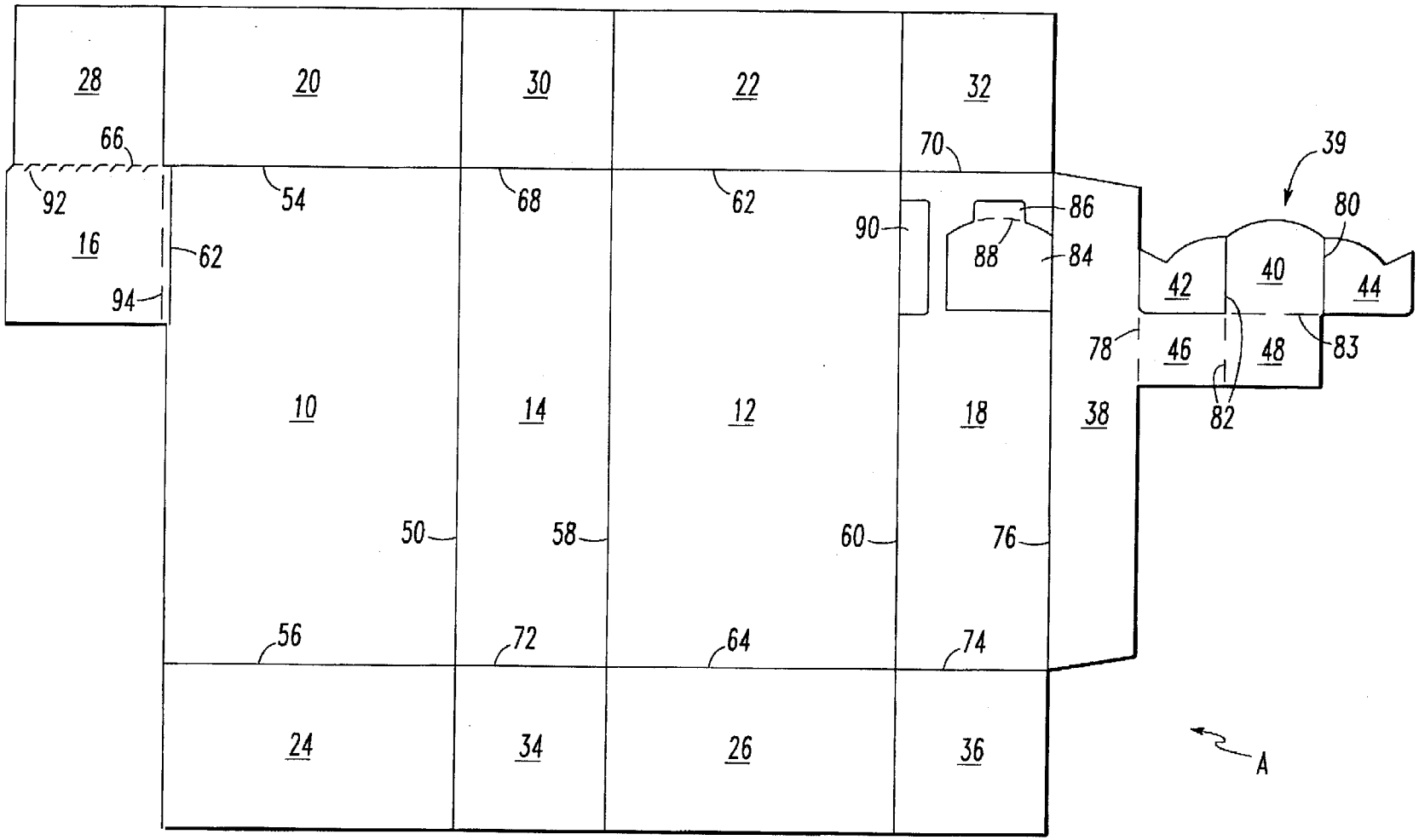
FIG. 1 is a plan view of a cut and scored paperboard blank for forming a carton in accordance with the present invention.

The present invention relates to a paperboard carton having a side panel pour spout and is discussed in reference to the drawings. The invention will be described in greater detail with like elements of the several figures being referenced by like numerals. FIG. 1 of the drawings illustrates a unitary blank (A) which is a foldable sheet material from which a carton (B) illustrated in FIG. 2 may be formed. Unitary blank (A) may be formed of a paperboard material or other conventional material for forming cartons of this type, depending on their intended use. Unitary blank (A) includes a main front panel (10), a main back panel (12), a side panel (14), which is integrally connected to both front panel (10) and back panel (12), as well as a partial side panel (16) and a side panel (18). The carton blank (A) further includes top end panels (20) and (22), bottom end panels (24) and (26), as well as minor flaps (28), (30), (32), (34), and (36). In addition, carton blank (A) includes inner flap (38) which is connected to side panel (18). Connected with inner flap (38) is a spout panel (39) which includes main spout panel (40), having side spout panels (42) and (44) connected thereto. Lower spout panels (46) and (48) are located beneath side spout panel (42) and main spout panel (40), respectively. The bottom edge of side spout panel (42), however, is not connected to lower spout panel (46).

The particular closing structure of especially the end flaps in the present embodiment may take a variety of configurations while not departing from the intended scope of the invention. The front main panel (10) is hingedly connected to both the side panel (14) and partial side panel (16), as well as top end panel (20) and bottom end panel (24) by way of pre-scored fold lines (50), (52), (54), and (56), respectively. Likewise, the back panel (12) is hingedly connected to side panel (14), side panel (18), top end panel (22), and bottom end panel (26) by way of pre-scored fold lines (58), (60), (62), and (64), respectively. Inner flap (38) is hingedly connected to side panel (18) by way of pre-scored fold line (76). Moreover, spout panel (39) connects to inner panel (38) by way of pre-scored fold line (78). The spout panel is further foldable, in that, side spout panel (42) and lower spout panel (46) are hingedly connected to main spout panel (40) and lower spout panel (48), respectively, by way of pre-scored fold line (82). Side spout panel (44) is further connected to main spout panel (40) by way of pre-scored fold line (80). Main spout panel (40) hingedly connects with lower spout panel (48) by way of prescored fold line 83. By folding the carton blank (A) along the above-described pre-scored fold lines, the carton (B) illustrated in FIG. 2 will be formed.

Side panel (18) includes a closure flap (84) which is cut from an upper portion of side panel (18). Closure flap (84) may be formed adjacent to fold line (76), however, one skilled in the art would appreciate that this closure flap may be positioned anywhere on panel (18) to facilitate the removal of contents within formed carton (B) of FIG. 2. Located directly above closure flap (84) is tab (86), which shares perforation line (88) with closure flap (84). Directly adjacent to closure flap (84) is an embossed, reverse, cut score region (90), which is formed adjacent to fold line (60) separating back panel (12) and side panel (18). This reverse cut score region (90) is also cut from an upper portion of panel (18). The significance of reverse cut score region (90) will be described in greater detail hereinbelow.

Partial side panel (16), illustrated in FIG. 1, includes perforation cuts (92) along creased fold-line (66). In addition, a cut score area (94) is provided adjacent to fold line (52) and is perpendicular to perforation cuts (92). As a further note, partial side panel (16) extends beyond end flap (28) and, as can be seen by FIG. 1, is configured to be removed from carton blank (A) by tearing the perforation cuts (92) and cut score area (94). As will be discussed in greater detail hereinafter, when it is desired to initially open carton (B), the consumer will forcibly remove partial side panel (16) at perforation cuts (92) and cut score area (94), which will, during its removal, expose closure flap (84) located on side panel (18).

Figure 2:
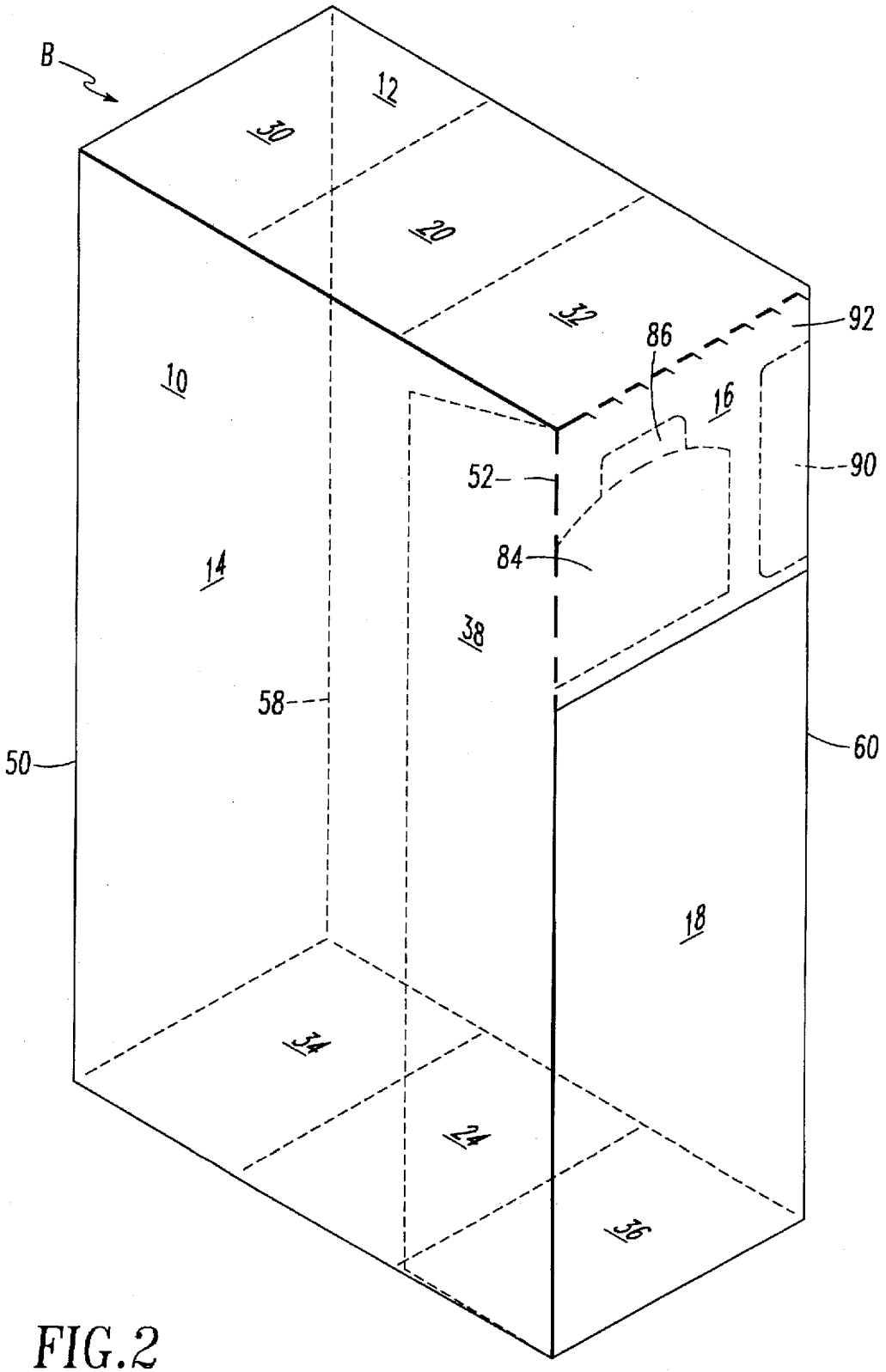
FIG. 2 is a perspective view of a fully erect carton in its initial condition formed from the paperboard blank of FIG. 1.

FIG. 2 is a prospective view of carton (B) fully formed from unitary blank (A) of FIG. 1. As shown in FIG. 2, carton (B) is formed by folding front panel (10) and back panel (12) about side panel (14) along fold lines (50) and (58), as well as folding side panel (18) at told line (60).

The folding of spout panel (39) will now be discussed in reference to FIG. 1. Spout panel (39) is first folded about fold line (78) so that the panel is flush against the inner side of panel (38) and (18). Side spout panel (44) is then folded upward so that it is collinear with side spout panel (42). Once in this condition, inner panel (38) may be positioned and adhered to the inner side of front panel (10), as shown in FIG. 2. Moreover, partial side panel (16) is then folded at crease line (94) to act as a protective flap such that it covers closure flap (84) and reverse cut score region (90) on which side panel (16) is adhered to form a tight, secure seal over closure flap (84). Subsequently, the top and bottom panels, as well as the minor flaps, may be folded in order to close and form carton (B).

Figure 3:
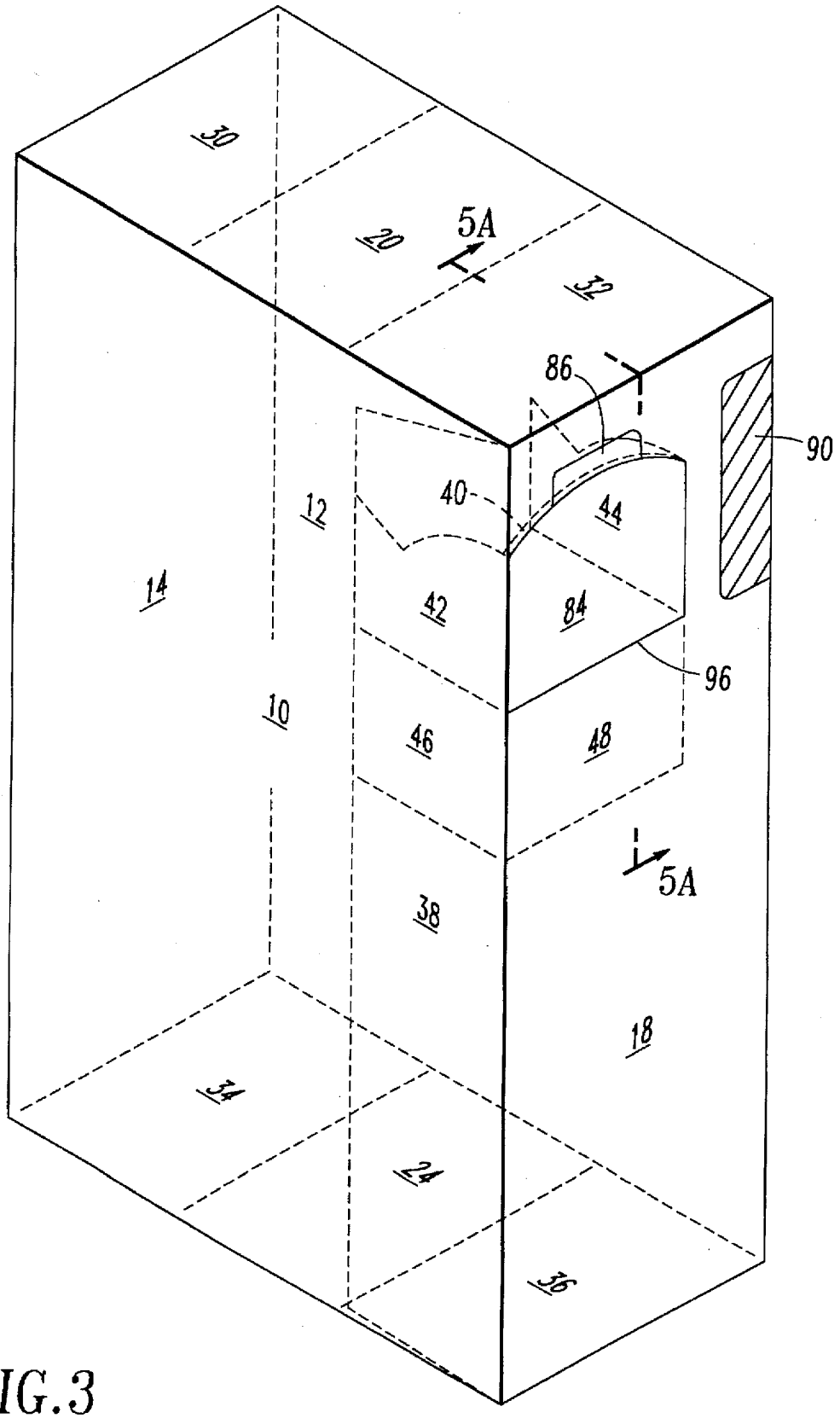
FIG. 3 is a perspective view of the carton of FIG. 2 in a closed condition upon removing the protective flap.

In order to initially open carton (B), the consumer will apply an outward force to the extension of partial side panel (16), which will result in a ply separation at the die cut portion of the reverse cut score region (90), as well as a continuous tear along perforation cuts (92) until cut score area (94) is reached. At this point, the consumer will tear partial side panel (16) from carton (B) by tearing cut score area (94) and ultimately removing partial side panel (16). After removing partial side panel (16), the upper portion of panel (18) is exposed, thus, revealing closure flap (84), upper tab (86) and reverse cut score region (90), as shown in FIG. 3. Reverse cut score region (90) will be torn when partial side panel (16) is removed.

In this condition, the consumer can now access the spout of carton (B) which is comprised of closure flap (84), main spout panel (40) and side spout panels (42) and (44). The spout is formed by adhering main spout panel (40) to the back side or inner panel of closure flap (84). Both main spout panel (40) and closure flap (84) have the same size and dimensions to form a uniform spout for emptying the contents from the carton. Closure flap (84) is integrally formed with side panel (18) such that it creates a smooth surface along the entire side of side panel (18).

Figure 4:
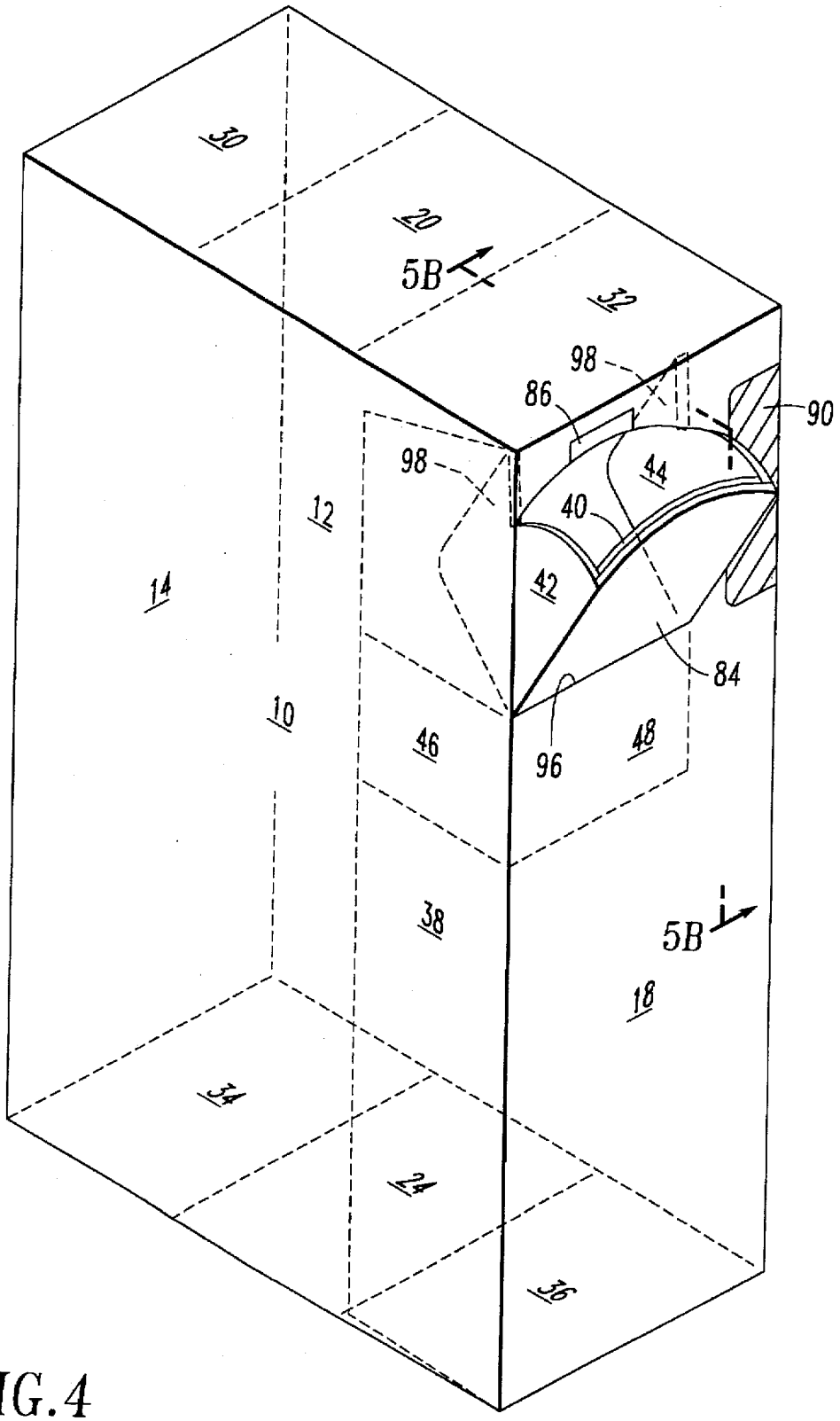
FIG. 4 is a perspective view of the carton of FIG. 3 in an open condition.

To open the spout of carton (B), the consumer would apply a force to the top portion of closure flap (84) and pull the spout portion downward. At this point, carton (B) is in an open condition, as shown in FIG. 4. To access the upper portion of closure flap (84) a consumer would push in tab (86) to the extent that they can access the top portion of closure flap (84) to pull downward and thus open the spout of carton (B). To close the spout of carton (B) a consumer would just apply an opposite force and push the spout upward until it is flush with side panel (18) to secure the contents of the carton therewithin. The spout is hingedly connected to side panel (18) at fold line (96) which allows the spout to be opened and closed repeatedly and secured in a closed position.

Figure 5A:
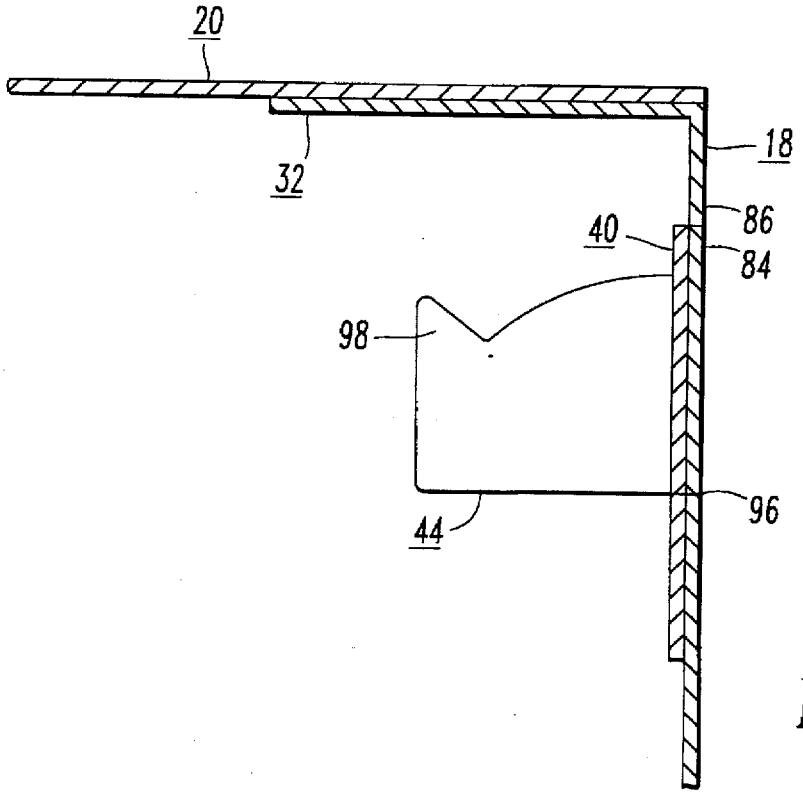
FIG. 5*a* is an expanded cross-sectional view of the closed carton taken along line Va—Va of FIG. 3.
Figure 5B:
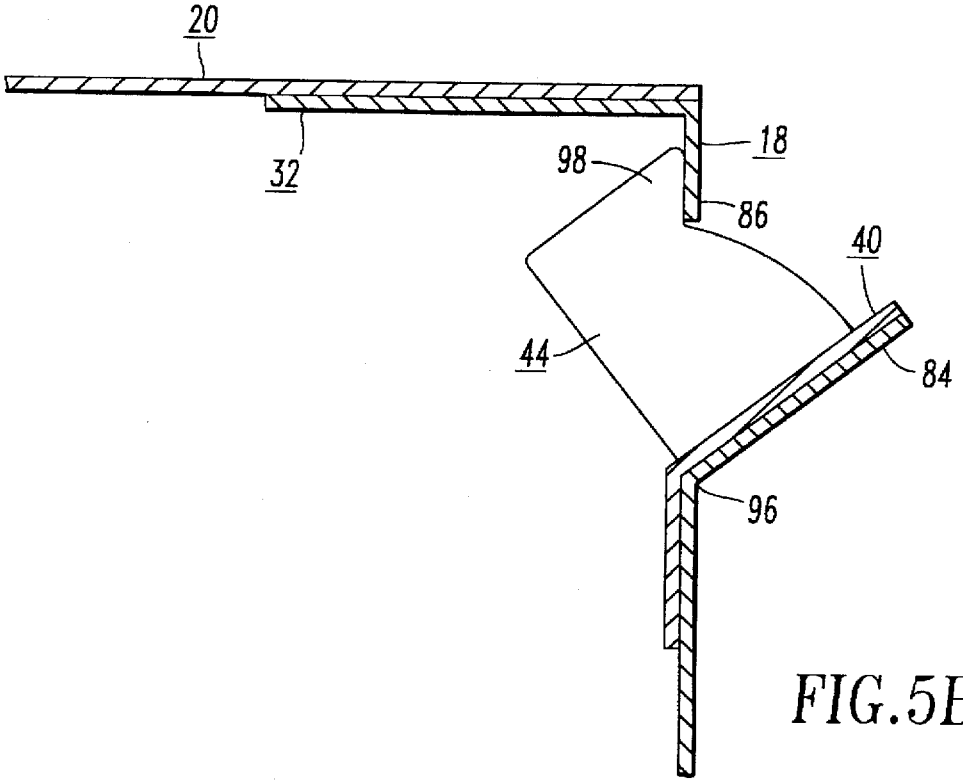
FIG. 5*b* is an expanded cross-sectional view of the opened carton taken along line Vb—Vb of FIG. 4.

FIGS. 5(*a*) and 5(*b*) are an expanded cross-sectional view of closed carton (B) as taken along lines V(a)—V(a) of FIG. 3 and of V(b)—V(b) of FIG. 4, respectively. Referring to FIG. 5(*a*), the view shows the spout of carton (B) in a closed position. The spout in the preferred embodiment of the present invention is reinforced using the 2-ply configuration, namely main spout panel (40) and closure flap (84), shown in FIG. 5(*a*). By having main spout panel (40) adhere to closure flap (84) it creates a multi-ply bond, and thus, a stronger spout for pouring materials therethrough. Closure flap (94) engages side panel (18) to create a secure seal, as shown in 5(*a*). This seal maintains its integrity through many uses of opening and closing flap (84) to empty the contents of carton (B).

FIG. 5(*b*) shows carton (B) in an open position wherein the spout hinged at fold line (96) is extended outward from the carton to allow contents to be poured therethrough. Side spout panels (44) and (42) include retention wings (98) which restrict the distance that the spout can be opened. As shown in FIG. 5(*b*), the spout is opened a predetermined distance to allow the desired amount of material to be emptied from the carton. Retention wings (98) engage the upper and inner walls of side panel (18) to restrict the opening of the spout. These retention wings can be formed in a manner to allow the spout to open further or to open less than that shown in FIG. 5(*b*). One skilled in the art should recognize that the spout can be configured in any manner to allow a user to increase or decrease the size of the opening for pouring contents from carton (B). As a consequence of restricting the opening of the spout, retention rings (98) also constrict the flow of material from carton (B). This configuration allows a consumer to meter and more accurately pour a particular amount of contents from carton (B). If the opening were too large, it would be more difficult for the consumer to meter the large amount of material flowing through the spout. Therefore, a restricted opening allows a consumer to more effectively meter the amount of materials being poured from the carton. The multi-ply spout design along with the retention wings provide a very durable and stable spout opening for a cardboard box that may be used numerous times without worry that the contents from the carton will be spilled or leak. In addition, the spout design of the present invention is as easy to use as the metal and plastic spout designs of the past.

While the invention has been described with reference to the preferred embodiment, it should be appreciated by those skilled in the art that the invention may be practiced otherwise than as specifically described herein without departing from the spirit and scope of the invention. It is therefore, understood that the spirit and scope of the invention be limited only by the appended claims.

What is claimed is:

1. A blank for forming a carton having a tear open pour spout for dispensing material contained therein, comprising:

a first main panel having first and second side panels and end flaps hingedly connected thereto by way of fold lines;

a second main panel hingedly connected to said second side panel and having a third side panel and end flaps hingedly connected thereto by way of fold lines;

a closure means formed in said third side panel; and a spout means hingedly connected to said third side panel, wherein said spout means is folded to form a spout which is covered by said closure means when said carton is formed.

2. The blank of claim 1 wherein said blank is formed of paperboard and said first and second side panels each include at least one flap hingedly connected thereto at a crease score fold line.

3. The blank of claim 1 wherein said first side panel covers said closure means to form a protective flap when said carton is formed.

4. The blank of claim 3 wherein said protective flap is embossed at said crease score fold line.

5. The blank of claim 1 where said hinge connecting said first main panel and said first side panel is embossed.

6. The blank of claim 1 wherein said first main panel includes a cut score adjacent to the hinge connecting said first side panel to said first main panel.

7. The blank of claim 3 wherein said third side panel includes an embossed reversed cut score region adjacent said second panel, on which said protective flap is adhered when said carton is formed, such that upon application of an opening force an area of paperboard material between said reverse cut scores will ply separate and release said protective flap.

8. The blank of claim 1 further comprising a fourth panel between said third side panel and said spout means and hingedly connecting said third side panel and said spout means.

9. The blank of claim 1 wherein said spout means includes a main spout panel and a first and second side spout panel, said main spout panel having a bottom panel connected thereto.

10. The blank of claim 8 wherein the hinge connecting said spout means and said fourth side panel is embossed.

11. The blank of claim 1 wherein said third side panel includes an embossed tab region positioned above said closure means.

12. A carton having a reclosable tear open pour spout for dispensing materials in the carton, comprising:

a plurality of side walls hingedly connected to one another by way of fold lines, a top wall and a bottom wall, with one of said side walls including an outer panel and an inner panel adhesively secured thereto;

a closure means formed in said inner panel;

a protective means formed in said outer panel for sealing the materials inside said carton until the initial use; and a spout means hingedly connected with said inner panel, said spout means being adhered to said closure means, wherein said spout means and said closure means extend outward from said carton when opened to form a spout through which materials in said carton may be poured.

13. The carton of claim 12 further comprising a retention means formed in said spout means for contacting the inner surface of said carton when the spout is opened to keep said spout from opening beyond a predetermined distance and to constrict the flow of material from said carton.

14. The carton of claim 12 wherein said spout means includes a bottom wall with two curved side walls.

15. The carton of claim 12 wherein said inner panel further includes an embossed tab region positioned above said closure means to facilitate opening and closing the pour spout.

16. The carton of claim 12 wherein said inner panel further includes an embossed reverse cut score region adjacent said closure means, to which said protective means is adhered when said carton is formed, such that upon application of an opening force an area of paperboard material between said reverse cut scores will ply separate and release said tear protective means.

17. The carton of claim 16 wherein said embossed reverse cut score region extends beyond the periphery of said inner panel.

18. The carton of claim 12 wherein said outer panel includes a cut score area on said protective means to facilitate the removal of said protective means upon opening said carton.

19. The carton of claim 12 wherein said closure means is integrally formed with said inner panel to create a secure closure of said spout means to prevent leakage after each use.

20. The carton of claim 12 wherein said carton comprises paperboard.

* * * * *